United States Patent [19]

Hildeman et al.

[11] 4,435,213

[45] Mar. 6, 1984

[54] METHOD FOR PRODUCING ALUMINUM POWDER ALLOY PRODUCTS HAVING IMPROVED STRENGTH PROPERTIES

[75] Inventors: Gregory J. Hildeman, Murrysville; John C. Kuli, Jr., Saxonburg; Leo A. Vivola, New Kensington, all of Pa.

[73] Assignee: Aluminum Company of America, Pittsburgh, Pa.

[21] Appl. No.: 417,796

[22] Filed: Sep. 13, 1982

[51] Int. Cl.[3] ..... C21D 1/02

[52] U.S. Cl. ..... 75/249; 148/11.5 P; 419/38; 419/48; 419/49; 419/50; 419/60; 419/31

[58] Field of Search ..... 148/11.5 P, 11.5 A; 419/38, 31, 48, 28, 49, 50, 52, 60; 75/249

[56] References Cited

U.S. PATENT DOCUMENTS

| | | | |
|---|---|---|---|
| 3,544,392 | 12/1970 | Lyle et al. | 148/11.5 P |
| 3,611,546 | 11/1968 | Haller | 419/48 |
| 3,954,458 | 5/1976 | Roberts | 419/31 |
| 4,177,069 | 12/1979 | Kobayashi et al. | 419/38 |
| 4,285,739 | 8/1981 | Deruyttere et al. | 148/11.5 P |

*Primary Examiner*—L. Dewayne Rutledge
*Assistant Examiner*—Debbie Yee
*Attorney, Agent, or Firm*—Carl R. Lippert

[57] ABSTRACT

Aluminum alloy atomized or other powder is compacted and shaped into a useful article including heating the compact rapidly by induction heating techniques. Such rapid induction heating results in improved strength or toughness properties without substantial penalty in elongation, thereby rendering the product so produced more useful in high strength applications. The product so produced may be subsequently shaped by forging, extruding or rolling processes.

43 Claims, No Drawings

METHOD FOR PRODUCING ALUMINUM POWDER ALLOY PRODUCTS HAVING IMPROVED STRENGTH PROPERTIES

BACKGROUND OF THE INVENTION

This invention relates to the production of improved aluminum alloy powder-derived products characterized by improved strength properties and therefore useful in structural aerospace components and other applications requiring high strength and relates to methods for producing such improved strength powder-derived products.

The invention here described was made in the course of or under a contract or subcontract thereunder with the United States Air Force.

Aluminum alloys have enjoyed wide use in important applications such as aircraft were aluminum has become well known for its high strength to weight ratio. Various efforts have been employed to further improve the strength of aluminum alloys, including the use of aluminum powder-derived alloy products wherein aluminum powder is compacted and shaped into a useful article. Powder-derived aluminum products are generally considered to have improved mechanical properties such as strength or toughness over many nonpowder-derived products, as shown in various disclosures, for example, U.S. Pat. Nos. 2,963,780, 3,544,392, 3,637,441, 3,899,820, 3,954,458, and 4,104,061, incorporated herein by reference. Nonetheless, there continues a desire to still further improve the strength of powder-derived products.

Powder-derived products are produced from powders made by rapidly quenching atomized liquid aluminum alloys which results in a fine dispersion of intermetallic particles for strengthening compacts formed by squeezing or compacting such aluminum powders. In general, there are two types of aluminum powder alloys, heat treatable and non-heat treatable. In heat treatable alloys fine incoherent intermetallic particles, referred to as dispersoids, serve to control grain size and limit the amount of recrystallization by pinning grain boundaries to result in products with high strength and toughness. On the other hand, non-heat treatable dispersion strengthened aluminum alloys rely on the fine incoherent intermetallics to strengthen the aluminum matrix by impeding dislocation motion (plastic flow) due to their close spacing. In both alloy types it is desirable to maintain the dispersoid and intermetallic particles in a fine size and spacing to achieve good combination of strength and toughness. Various alloy refinements and process refinements have gone forward in order to further the property gain achieved by such dispersion hardening and there is a continuing desire to further improve the strength of compacted aluminum powder products. A strength increase of 5 to 10% is considered highly significant, and an increase of from 10 to 20% is considered extremely desirable, especially where such can be achieved by processing conditions which do not alter the alloy composition so as to permit continued use of known and reliable compositions but at a higher strength level.

DESCRIPTION

In accordance with the invention, aluminum powder products are compacted and shaped into useful structures having improved strength properties both at room temperature and at elevated temperature, such as at temperatures of 450° F. or even higher. In practicing the invention, the aluminum powders are compacted and heated to relatively high temperatures under sufficient pressure to produce a compact of very high density, over 90 and preferably over 95% of theoretical or full density. It is important in accordance with the invention in order to achieve the desired strength improvement that the heating of the compact be performed by induction internal heating techniques wherein electric currents such as eddy currents are induced within the compact to rapidly internally heat it to the desired temperature. The rapid induction heating enables reaching the relatively high temperatures such as 800° F. required to release chemically bonded water vapor and other gases while reducing the time during which coarsening or agglomeration of the intermetallic particles can take place. Thus, the rapid induction heating in accordance with the invention results in a highly desired fine and closely spaced dispersoid structure so as to improve mechanical properties of aluminum powder derived products.

Powders useful in practicing the invention are preferably produced by atomizing a well-mixed superheated molten alloy, although other particulate production techniques, such as splat or melt spun ribbon methods which are also capable of achieving rapid quenching, are also believed suitable for production of aluminum alloy particulate in practicing the invention. It is preferred that atomization be carried out in a relatively non-oxidizing condition or gas in order to reduce the oxide content of the powder. Flue gas has been found to be adequate although other non-oxidizing gases may also serve the purpose. Powder production conditions may be carried out to produce particles of a size finer than 100 mesh, preferably such that at least 85% of the powder passes through a 325 mesh screen (Tyler Series). In addition to avoiding high oxide content, it will be appreciated that the cleanliness of the powder is also significant in producing quality powder and products derived therefrom.

Various aluminum alloy powder compositions can be used in practicing the invention, although the extent of the improvement may be more pronounced with some alloys than with others. Table I lists a number of alloys which are believed suitable for practice of the invention. Compositions herein are by weight percent unless indicated otherwise.

TABLE I

| Principal Elements | Zn | Mg | Cu | Fe | Si | Mn | Cr | Co | Zr | Ni | Al |
|---|---|---|---|---|---|---|---|---|---|---|---|
| Al—Zn—Mg | 3–14 | .5–4.5 | 3* | 3* | 0.5* | 2* | 1* | 3* | 2* | 3* | Bal |
| Al—Cu | 5* | 5* | 1–8 | 5* | 2* | 5* | 2* | 5* | 2* | 5* | Bal |
| Al—Mg | 5* | 1–8 | 2* | 3* | 2* | 5* | 2* | 3* | 2* | 3* | Bal |
| Al—Fe | 5* | 5* | 10* | .5–15 | 15* | 5* | 5* | 15* | 5* | 15* | Bal |
| Al—Mn | 5* | 3* | 3* | 7* | 10* | .5–15 | 5* | 7* | 3* | 7* | Bal |

TABLE I-continued

| Principal Elements | Zn | Mg | Cu | Fe | Si | Mn | Cr | Co | Zr | Ni | Al |
|---|---|---|---|---|---|---|---|---|---|---|---|
| Al—Si | 5* | 5* | 5* | 5* | 1-30 | 10* | 2* | 3* | 2* | 5* | Bal |

*NOTE: Ancillary alloy elements are designated without ranges and may be present in amounts up to the designated amounts as an addition or otherwise. Other elements which may be present include beryllium, titanium, vanadium, tungsten, molybdenum, niobium, tantalum and cerium, Mischmetal and rare earth elements in amounts not exceeding 10%. The combined total of all elements other than the principal elements and aluminum preferably does not exceed 25%.

The invention is considered particularly useful for those alloys requiring high strength or toughness which contain intermetallic or other dispersion particles which tend to coarsen or agglomerate at high temperatures or prolonged thermal exposures. In heat treatable alloys, dispersoids such as $Al_{12}Mg_2Cr$, $Al_{20}Mn_3Cu_2$, $Al_3Zr$ and $Co_2Al_9$ are examples of dispersed particles susceptible to thermal coarsening. In non-heat treatable alloys, intermetallics such as $Al_6Fe$, $Al_3Fe$ and $FeNiAl_9$ are examples of dispersed particles susceptible to thermal coarsening. As used herein, the term "dispersed particles" is intended to refer to all such particles as may be agglomerated or coarsened by thermal exposure whether the particles form on freezing or by subsequent precipitation or otherwise.

Table II lists specific examples of heat treatable (HT) and non-heat treatable (NHT) aluminum powder alloy compacts which have been processed according to the invention.

TABLE II

| Alloy | Alloy Type | Si | Fe | Cu | Mn | Mg | Cr | Ni | Co | Zn | Ce |
|---|---|---|---|---|---|---|---|---|---|---|---|
| a | NHT | 0.05 | 2.9 | 0.01 | 0.02 | — | — | 7.3 | — | — | — |
| b | NHT | 0.13 | 1.6 | — | — | — | — | 3.7 | — | 0.02 | — |
| c | NHT | 0.08 | 8.8 | — | 0.01 | — | — | 0.01 | — | — | 3.7 |
| d | HT | 0.12 | 0.15 | 1.0 | — | 2.5 | — | — | 1.6 | 8.0 | — |

NHT — non-heat treatable
HT — heat treatable

Prior to final compacting into a billet or useful shape, the powders can be isostatically compressed into a cohesive or coherent green compact shape for ease of handling. This can be effected by placing the powder within a bag, such as a rubber or plastic bag, which in turn is positioned within a hydraulc media for transmitting pressure through the bag to the powder. A pressure within the range of about 5 to 60 ksi can be applied to the hydraulic media to compress the powder into a cohesive shape of about 60 or to 90 or 95% of full density and referred to as green compact. The temperature for this green compact compression is preferably room temperature, or a temperature not over 250° F., preferably not over 125° F. Organic binders are preferably avoided in the green compact. The advantage of isostatic compaction is providing a coherent shape for further processing.

Preferably with, or less preferably without, preliminary isostatic compaction, the aluminum powder alloy is compacted to substantially full density at a relatively high temperature of over 650°, and preferably at least 700° or 750° F. When referring to substantially full density, it is intended that the compacted billet be substantially free of porosity with a density equal to 95% or more of the theoretical solid density, preferably 98 or 99% or more. It is desired that the compaction to full density be effected at a minimum temperature greater than 650° F., for instance 675° F. or higher, and preferably at a minimum temperature of 700° F. or 750° F. or higher. The maximum temperature for compaction should not exceed 1100° F. or 1200° F. and is preferably not over 1000° F. In some cases it is preferred to conduct the full density compaction under vacuum conditions or in a relatively non-oxidizing gaseous atmosphere. Vacuum compaction can be beneficial to the toughness of the powder product and is preferred where toughness is of high importance. In this procedure the powder or isostatically compacted and inductively heated green compact is placed in a chamber which is evacuated down to a pressure level of 1 torr, preferably $10^{-1}$ or $10^{-2}$ torr or less (1 torr equals 1 millimeter of Hg at 0° C.). The material may be compressed to substantially full density at the desired elevated temperature while it is still in the evacuated chamber.

In accordance with the invention it is important that the heating of the aluminum powder material for compaction be conducted rapidly by induction heating to the desired compacting temperature. The induction heating is typically effected by placing the isostatically compacted powder within an induction heating means arranged to induce current within the compact. A suitable arrangement for heating a cylindrical green compact is to employ a cylindrical induction coil with a core opening just larger than the compact and positioning the compact coaxially within the open core of the induction coil. Passing electric current through the induction coil induces current flow in the compact to heat it. The frequency and electrical parameters of the induction unit and size of the coil should be adjusted to provide for a high heatup rate to a substantially uniform temperature along the length of the pre-compact. For instance, an Ajax Magnatherm Induction heater operating at a frequency of 60 cycles per second with a 7.25 inch diameter coil can be used to heat 6-inch diameter compacts. It will be appreciated by those knowledgeable in the art that the depth of inductive heating is generally inversely proportional to the operating frequency of the coil. In addition, the geometry of the coil (number of turns, diameter and length) relative to the compact will influence the rate of heating. In practicing the invention it is preferred that the heatup time to at least 650° F. be not greater than 1 hour and preferably less than 30 minutes, for instance a heatup time to compaction temperature of less than 15 minutes has been used. This rapid inductive heatup rate provides much shorter heating times to elevated temperatures than prior art methods which rely upon conventional convective furnaces for externally heating compacts. Thermal cycle times of 8 to 25 hours have been reported for typical prior art approaches for heating the entire mass of even a small compact to desired temperature for degassing and subsequent pressing to full density. Rapid induction heating in accordance with the invention provides short heatup times for the high temperatures needed to release chemically bonded water and other gases thus reducing the opportunity for the slower thermal effect of coarsening or agglomeration of intermetallic particles to occur. Larger size compacts, for instance 20 to 30 inches or more, inherently can require longer heatup times than smaller sizes. Nonetheless, it is desired to limit the heatup time to not more than 0.2 hour per inch of thickness (e.g. diameter or minor transverse dimension), preferably not more than 0.15 hour per inch or, better yet, 0.1 hour per inch of thickness. Heatup rates not over 0.05 hour per inch of thickness have been employed with good results. This is contrasted with prior heatup rates of 1 or even 2 hours per inch of thickness.

After the powder compact is rapidly inductively heated to the desired temperature it may be held at that temperature for a sufficient time to allow decomposition and escape of water vapor, hydrogen or other contaminant gases before pressing to full density. The amount of time for such to occur depends somewhat on the particular temperature, density and size of the compact, with higher temperatures and smaller or more porous compacts favoring shorter times. For a compact 6 inches in diameter at 950° F., 30 minutes would be sufficient, whereas for a compact 12 inches in diameter at 950° F., a much longer time such as 60 minutes may be appropriate. Thus, the invention contemplates, after rapid induction heating to an elevated temperature, the possible incorporation of a hold time at an elevated temperature. The time allowed for degassing is preferably less than one-half hour but may be up to 7.5 hours or longer depending or related somewhat directly to compact size and somewhat inversely to temperature in order to evacuate (degas) the compact down to a pressure level of 1 torr, preferably $10^{-1}$ or $10^{-2}$ torr or less. Nonetheless, holding time at elevated temperature should not substantially exceed that required to allow decomposition and escape of water vapor and the like. It is important that the excessive agglomeration of dispersoid particles characteristic of prior art slow external heating practices be avoided to benefit from the practice of the invention and thus hold time at elevated temperature should be sufficient for the desired degassing effect but not so long as to negate or excessively compromise the benefits of the rapid heating to elevated temperature.

The temperature to which the compact is first inductively heated may exceed the temperature at which it is finally pressed to full density by 25° or 50° F. or as much as 200° or 300° F. especially where vacuum degassing is employed to improve toughness. Thus, a compact is inductively heated to a first temperature, for instance 950° F., and then placed in a vacuum chamber for vacuum degassing. In moving the compact to the degassing chamber and degassing for about 30 minutes, some temperature drop can occur to say 800° or 850° F. at which temperature the compact is pressed to full density. Another approach is to inductively heat a compact in an evacuation chamber thus eliminating the step of moving the compact for vacuum degassing. The compact can then be placed in a press for pressing to full density.

Following compacting to substantially full density, the compacted billet can be shaped such as by forging, rolling, extruding, or the like, or can be machined into a useful shape. It is preferred that the compact be worked by an amount equivalent to a reduction in cross section of at least 25%, preferably 50 or 60% or more, where practical, since such favors improved properties. Preferred temperatures for such working range from about 500° to about 850° F. or more.

EXAMPLE 1

An aluminum alloy a in Table II containing 7.3% nickel, 2.9% iron (by weight), balance aluminum, was provided as atomized powder and isostatically compacted to about 75% of full density at room temperature into cylindrical compacts about 4 inches in diameter and 12 inches long. Some of the compacts were heated in a standard air convection heated furnace of the type typically employed for heating such compacts. The amount of time taken to heat the compacts to desired temperatures which were selected at 700° and 800° F. required 7½ hours in the standard furnace. Comparison compacts were produced in accordance with the invention by induction heating in just under 12 minutes (0.18 hours) as indicated in Table III. In the case of the furnace-heated compacts, such were placed within cans and evacuated to facilitate vacuum hot pressing, whereas the compacts which were induction heated were not placed in cans and were not vacuum hot pressed. All of the compacts after heating were promptly hot pressed to substantially full density billets. After pressing to substantially full density, the billets were upset 60% (in height) by forging into discs and tensile test specimens taken at a point approximately ¼ of the thickness in from the outer surface. The results of the tensile property measurements taken at both room temperature and 450° F. are shown in Table III wherein it is readily apparent that the forgings made from induction heated compacts, 1-B, 1-D and 1-F, exhibited substantially higher strength properties compared to forgings made from furnace heated compacts, 1-A, 1-C and 1-E.

TABLE III

| | Compact Consolidation | | | | Mechanical Properties | | | | |
|---|---|---|---|---|---|---|---|---|---|
| | | | | | Test | | | | |
| Examples | Heating Method | Time Hrs. | Temp. °F. | Vacuum Compaction | Temp. °F. | Yield ksi | Tensile ksi | % Elong. | $K_{IC}$ ksi $\sqrt{in}$ |
| 1-A | Furnace | 7.5 | 700 | Yes | 450 | 28.6 | 34.4 | 13 | — |
| 1-B | Induction | 0.18 | 700 | No | 450 | 33.6 | 34.9 | 5 | — |
| 1-C | Furnace | 7.5 | 800 | Yes | Room | 48.2 | 60.3 | 12.2 | 32* |
| 1-D | Induction | 0.19 | 800 | No | Room | 54.5 | 66.4 | 11.2 | 19* |
| 1-E | Furnace | 7.5 | 800 | Yes | 450 | 24.9 | 30.5 | 16 | — |
| 1-F | Induction | 0.19 | 800 | No | 450 | 26.2 | 32.8 | 14 | — |
| 2-A | Furnace | 7.5 | 775 | Yes | Room | 46.6 | 61.2 | 14.7 | — |
| 2-B | Induction | 0.5 | 775 | Yes | Room | 49.6 | 65.4 | 10.3 | — |

TABLE III-continued

| | Compact Consolidation | | | | Mechanical Properties | | | | |
|---|---|---|---|---|---|---|---|---|---|
| | | | | | Test | | | | |
| Examples | Heating Method | Time Hrs. | Temp. °F. | Vacuum Compaction | Temp. °F. | Yield ksi | Tensile ksi | % Elong. | $K_{IC}$ ksi $\sqrt{in}$ |
| 2-C | Furnace | 7.5 | 775 | Yes | 450 | 36.7 | 40.9 | 4.3 | — |
| 2-D | Induction | 0.5 | 775 | Yes | 450 | 40.0 | 44.6 | 6.4 | — |
| 3-A | Furnace | 30 | 950 | Yes | Room | 84.0 | 90.1 | 10 | 17.6** |
| 3-B | Furnace | 7.5 | 950 | Yes | Room | 85.2 | 90.9 | 10 | 18.1** |
| 3-C | Induction | 0.17 | 950 | Yes | Room | 86.4 | 91.7 | 8.3 | 20.7** |

*$K_{IC}$ determined from slow bend charpy specimens in transverse direction of forged disk
**$K_{IC}$ determined from compact tension specimens per ASTM E-399 (longitudinal transverse crack)

The extent of the improvement in Example 1-B is quite significant in that an 18% increase in yield strength at 450° F. is achieved by rapid induction heating compared to the furnace heating to the 700° F. hot pressing temperature. At a hot pressing temperature of 800° F. the results in Examples 1-D and 1-F were still impressive in that at room temperature a 13% increase and at 450° F. a 5% increase in yield strength is achieved. Equally significant is that the strength improvements of the forgings fabricated from the induction heated billets are achieved without serious penalty in elongation. A lower fracture toughness was, however, obtained in 1-D compared to 1-C because the compact in 1-D was not evacuated before hot compaction to full density whereas 1-C was evacuated to achieve the toughness benefit.

EXAMPLE 2

A non-heat treatable alloy, c in Table II, containing about 8.8% iron and 3.7% cerium (by weight), balance aluminum, was produced as atomized powder and isostatically compacted at room temperature into compacts about 6 inches in diameter and 18 inches long. One (2-A) was encapsulated and vacuum degassed at about 775° F. for 7.5 hours in a furnace and hot pressed to full density. A similar compact (2-B) with an identical composition was induction heated to 775° F. in 30 minutes under a flowing argon gas cover. The inductively heated compact (2-B) was subsequently transferred to a cylinder, evacuated and hot pressed to full density. Both the furnace heated and induction heated billets were subsequently hot extruded to $\frac{3}{4}\times 4.0$ inch bars under the same conditions. Table III shows that the room temperature yield strength of the extrusions from induction heated compact (2-B) is 6% greater than the extrusions from the furnace heated compact (2-A) while yield strength derived from the induction heated compact at 450° F. (2-D) is 9% higher than 2-C.

EXAMPLE 3

In addition to strength, the combination of high strength with good fracture toughness is desirable in Al-Zn-Mg-Cu type aluminum alloys. Alloy d (Table II) containing about 8% zinc, 2.5% magnesium, 1% copper, 1.6% cobalt, balance aluminum, was produced as a prealloyed powder cold isostatically compacted, encapsulated in a can and furnace heated during continuous evacuation as in Example 2-A. Canned compacts were evacuated for 30 hours and for 7.5 hours at 950° F. After degassing, the compacts were hot pressed to full density and subsequently hot extruded. Another isostatically compacted compact (3-C) was induction heated to a temperature of 950° F. under an argon gas cover and transferred to a cylinder which was evacuated for vacuum degassing and hot pressed to full density and subsequently hot extruded. Heating and degassing times for the induction heated compacts (3-C) were 10 minutes or less as indicated in Table III. All of the extrusions were solution heat treated, cold water quenched and aged for 24 hours at 250° F. followed by 1 hour at 325° F. to a T7 type temper. Table III lists the average strength and toughness resulting from each of the three processes. It can be noted that the average properties of extrusion from the induction heated compacts (3-C) achieved the best combination of strength and toughness (14 and 18% improvement, respectively) compared to the furnace heated compact-derived products (3-A and 3-B).

The practice of the invention results in improvements of at least 5%, more suitably improvements of 8% and approaching and even exceeding 10% in one or more mechanical properties, strength or toughness, or both. Moreover, the improvement can be achieved without changing alloy composition so as to be useful in benefiting products made from alloys of known dependability.

While the invention has been described with particular reference to aluminum wrought products fashioned from aluminum particulate materials containing over 50% aluminum, it is believed that the invention also may be useful in producing improved articles and products fashioned from other induction heatable metal powders such as iron, nickel, cobalt, titanium and magnesium-base alloys, particularly where such particulates include strengthening dispersoids and temperature degradable phases whose production includes heating at temperatures sufficient to degrade such properties.

Also, while the invention is described with particular reference to rapid heating of powder compacts by induction heating techniques, it is believed other techniques may also be useful such as other internal heating techniques.

While the invention has been described in terms of preferred embodiments, the claims appended hereto are intended to encompass all embodiments which fall within the spirit of the invention.

What is claimed is:

1. A method of producing an improved metal article having improved mechanical properties comprising the steps:

(a) providing metal alloy particulate, said alloy being selected to provide strength enhancing dispersed particles capable of degradation at elevated temperatures; and (b) heating said metal to elevated temperature at a rapid heat-up rate and compacting said metal at elevated temperature to a substantially full density compact, said heat-up rate being such that said heating of said metal to elevated temperature is effected in not more than 0.2 hour for each inch of thickness of said compact, thereby improving said compact such that products made therefrom exhibit an improvement of at least 5% in one or more mechanical properties over a product likewise produced except for said heating occurring over a substantially longer time.

2. The method according to claim 1 wherein said metal contains more than 50% aluminum.

3. The method according to claim 2 wherein said heating in said step (b) is to a temperature above 700° F.

4. The method according to claim 2 wherein said heating in said step (b) is to a temperature of between 700° and 1000° F.

5. The method according to claim 1 wherein prior to said heating, said metal particulate is compacted at a temperature below said elevated temperature to form a cohesive self-supporting compact.

6. The method according to claim 1 wherein said heating is by internal heating.

7. The method according to claim 1 wherein said heating is by inductive heating.

8. The method according to claim 1 wherein said metal is subjected to vacuum degassing at elevated temperature.

9. A method of producing an improved aluminum article having improved mechanical properties comprising the steps:

(a) providing aluminum alloy particulate, said alloy being selected to provide strength enhancing dispersed particles capable of degradation at elevated temperatures above 650° F.;

(b) compacting said aluminous particulate at a temperature below 250° F. to form a cohesive self-supporting green compact;

(c) rapidly induction heating said green compact in a relatively non-oxidizing atmosphere at a high heat-up rate to an elevated temperature above 650° F., said heat-up rate being such that said heating to said elevated temperature is effected in not more than 0.2 hour per inch of compact thickness; and (d) compacting said induction heated green compact at an elevated temperature above 650° F. to substantially full density; thereby improving said compact such that products made therefrom exhibit an improvement of at least 5% in one or more mechanical properties over a product likewise produced except for the heating recited in step (c) being by external heating at a substantially slower rate over a substantially longer time.

10. The method according to claim 9 wherein said substantially full density compact is worked equivalent to a 25% reduction at a temperature of at least 250° F. to provide a worked product characterized by said improved mechanical properties.

11. The method according to claim 9 wherein said heating in said step (c) is to a temperature above 700° F.

12. The method according to claim 9 wherein said heating in said step (c) is to a temperature of between 700° and 1000° F.

13. The method according to claim 9 wherein said heating in said step (c) occurs in not more than 0.1 hour per inch of compact thickness.

14. The method according to claim 9 wherein, subsequent to said heating in said step (c), and utilizing heat imparted to said compact by said heating, said compact is held at elevated temperature for a sufficient time to allow release of chemically bonded water.

15. The method according to claim 10 wherein said temperature is at least 500° F.

16. The method according to claim 15 wherein said working is equivalent to a reduction of at least 50%.

17. The method according to claim 9 wherein said compacting in said step (d) is effected at substantially the same elevated temperature as that to which the compact is rapidly heated in said step (c).

18. The method according to claim 9 wherein said compacting in said step (d) is effected at an elevated temperature below that to which the compact is rapidly heated in said step (c).

19. The improvement according to claim 9 wherein said compact is vacuum degassed at a temperature above 650° F. before reaching substantially full density.

20. The improvement according to claim 19 wherein said degassing is performed after said rapid heating in said step (c) and before the compacting of said step (d).

21. The improvement according to claim 19 wherein said degassing is performed after said rapid heating in said step (c) and before the compacting of said step (d) and said compacting is effected at substantially the same elevated temperature as that to which the compact is rapidly heated in said step (c).

22. The improvement according to claim 19 wherein said degassing is performed after said rapid heating in said step (c) and before the compacting of said step (d) and said compacting is effected at an elevated temperature below that to which the compact is rapidly heated in said step (c).

23. The improvement according to claim 9 wherein said heating in said step (c) occurs in one hour or less.

24. The improvement according to claim 9 wherein said heating in said step (c) occurs in less than 0.15 hour per inch of compact thickness.

25. The improvement according to claim 9 wherein said heating in said step (c) occurs in less than 0.1 hour per inch of compact thickness.

26. The improvement according to claim 9 wherein said aluminum alloy is selected from the group consisting of (a) Al-Zn-Mg alloys containing 3 to 14% zinc and 0.5 to 4.5% magnesium; (b) Al-Cu alloys containing 1 to 8% copper; (c) Al-Mg alloys containing 1 to 8% magnesium; (d) Al-Fe alloys containing 0.5 to 15% iron; (e) Al-Mn alloys containing 0.5 to 15% manganese; and (f) Al-Si alloys containing 1 to 30% silicon.

27. The improvement according to claim 9 wherein said heating in said step (c) is performed in a relatively non-oxidizing atmosphere.

28. The improvement according to claim 9 wherein said heating in said step (c) is performed in a relatively non-oxidizing atmosphere and said compact is vacuum degassed at a temperature above 650° F. before said compacting in said step (d).

29. A method of producing an improved aluminum article having improved strength properties comprising the steps:

(a) providing aluminum alloy particulate, said alloy being selected to provide strength enhancing dispersed particles capable of degradation at elevated temperatures above 650° F.;

(b) compacting said aluminous particulate at a temperature below 250° F. to form a cohesive self-supporting green compact;

(c) rapidly induction heating said green compact in a relatively non-oxidizing atmosphere at a high heat-up rate to a temperature above 700° F., said heat-up rate being such that said heating to said temperature is effected in not more than 0.15 hour per inch of compact thickness;

(d) holding said rapidly heated-up compact at a temperature above 700° F.;

(e) compacting said induction heated green compact at a temperature above 700° F. to substantially full density; and (f) working said substantially full density compact equivalent to a reduction of at least 25% at a temperature of at least 500° F. to provide a worked product; said worked product exhibiting an improvement of at least 5% in one or more mechanical properties over a like-produced product except for the heating recited in said step (c) being by external heating at a substantially slower rate over a substantially longer time.

30. The method according to claim 29 wherein said working is equivalent to a reduction of at least 50%.

31. The method according to claim 29 wherein said compacting in said step (d) is effected at substantially the same elevated temperature as that to which the compact is rapidly heated in said step (c).

32. The method according to claim 29 wherein said compacting in said step (d) is effected at an elevated temperature below that to which the compact is rapidly heated in said step (c).

33. The improvement according to claim 29 wherein vacuum degassing is performed after said rapid heating in said step (c) and before the compacting of said step (d) and said compacting is effected at substantially the same elevated temperature as that to which the compact is rapidly heated in said step (c).

34. The improvement according to claim 29 wherein vacuum degassing is performed after said rapid heating in said step (c) and before the compacting of said step (d) and said compacting is effected at an elevated temperature below that to which the compact is rapidly heated in said step (c).

35. The improved product produced according to the method of claim 1.

36. The improved product produced according to the method of claim 9.

37. The improved product produced according to the method of claim 29.

38. The improved product produced according to the method of claim 2.

39. The improved product produced according to the method of claim 3.

40. The improved product produced according to the method of claim 5.

41. The improved product produced according to the method of claim 6.

42. The improved product produced according to the method of claim 7.

43. The improved product produced according to the method of claim 8.

* * * * *